United States Patent [19]

MacKechnie

[11] Patent Number: 5,033,739

[45] Date of Patent: Jul. 23, 1991

[54] HAND-HELD DEVICE FOR AQUATIC EXERCISING

[75] Inventor: Bruce MacKechnie, Annandale, Va.

[73] Assignee: Adams Mfg., Portersville, Pa.

[21] Appl. No.: 493,846

[22] Filed: Mar. 15, 1990

[51] Int. Cl.[5] ..... A63B 21/00

[52] U.S. Cl. ..... 272/116; 272/1 B; 272/71

[58] Field of Search ..... 272/67, 68, 71, 96, 272/116, 130, 143, 1 B; 441/55-59; 434/254

[56] References Cited

U.S. PATENT DOCUMENTS

| | | | |
|---|---|---|---|
| 4,416,451 | 11/1983 | Solloway | 272/116 |
| 4,480,829 | 11/1984 | Yacoboski | 272/116 |
| 4,623,142 | 11/1986 | MacKechnie | 272/116 |
| 4,632,387 | 12/1986 | Guzman | 272/116 |
| 4,819,951 | 4/1989 | Solloway | 272/116 |

FOREIGN PATENT DOCUMENTS

| | | | |
|---|---|---|---|
| 931201 | 6/1982 | U.S.S.R. | 272/71 |

*Primary Examiner*—Robert Bahr

*Attorney, Agent, or Firm*—Buchanan Ingersoll; Lynn J. Alstadt

[57] ABSTRACT

An aquatic exercising device including a handle member having first and second ends having first and second resistance members operatively affixed thereto. The resistance members are connected by flat panels of variable width which enable resistance to be adapted to the strength and capability of the user. Movement of the aquatic exercising device through a body of water produces a resistance to enhance the exercising capability of an individual utilizing the device. The device may be filled with water through removable caps at each end and used as a gravity weight for exercising. The device may also be emptied of water and used for flotation or buoyancy resistance exercises.

18 Claims, 3 Drawing Sheets

HAND-HELD DEVICE FOR AQUATIC EXERCISING

FIELD OF THE INVENTION

The present invention relates generally to a physical exercising device and more particularly to a hand-held, multi-directional, varied resistance device used in the performance of aquatic exercises.

BACKGROUND OF THE INVENTION

Exercise is recognized as an important aspect of maintaining or improving one's health at any age. Aquatic exercise is a very pleasant way to exercise the muscles and the cardio-vascular system because the body is cooled by the water and the movements are relatively smooth, rhythmic and easily moderated so that the chance of injury is greatly reduced. Water also increases the amount of effort needed to move the arms or legs in any direction, thus providing an excellent medium in which to exercise the entire body.

Various devices have been produced to facilitate the act of propelling oneself through the water by swimming with hand paddles or flippers on the feet. One device, U.S. Pat. No. 2,850,748, has been designed for use in performing certain aquatic exercises as well as for swimming. However, such a prior device does not recognize the advantage of providing multiple surfaces so configured as to enable the user to perform a broader range of exercises by being able to move the device in any direction through the water.

Applicant's U.S. Pat. No. 4,623,142, dated Nov. 18, 1986, relates to a hand-held, multi-directional device for aquatic exercising having a hollow central handle with outwardly facing, hollow funnel supports attached at each end thereof, so that water can flow through the hollow spaces in the funnel supports and into the handle. The funnel supports each contain vanes extending within the hollow spaces and protruding to varying extents through the funnel supports to their exteriors, so as to provide varying resistances to movement of the device through the water. The funnels and vanes also function to provide a high degree of stability to the device as it is moved through the turbulence of the aquatic medium.

SUMMARY OF THE INVENTION

The present invention improves the versatility of the device of U.S. Pat. No. 4,623,142 (the disclosure of which is incorporated herein by reference) in several ways.

In the first place, flat panel members connecting exterior portions of the vanes of the funnel supports at both ends of the handle, and being adjustable in width, make it possible to adapt the device to accommodate users of different strengths and at different stages of their training.

In the second place, by closing off the ends of the funnel members with dome-shaped elements closable by a cap, the device can be filled with or drained of water as desired, enabling it to be used as a gravity weight exercise device, a buoyancy resistance exercise device or a flotation device.

BRIEF DESCRIPTION OF THE DRAWINGS

In order that the invention may be more clearly understood, reference will now be made to the accompanying drawings, wherein an embodiment of the invention is shown for purpose of illustration, and wherein.

DESCRIPTION OF PREFERRED EMBODIMENT

Figure 1:
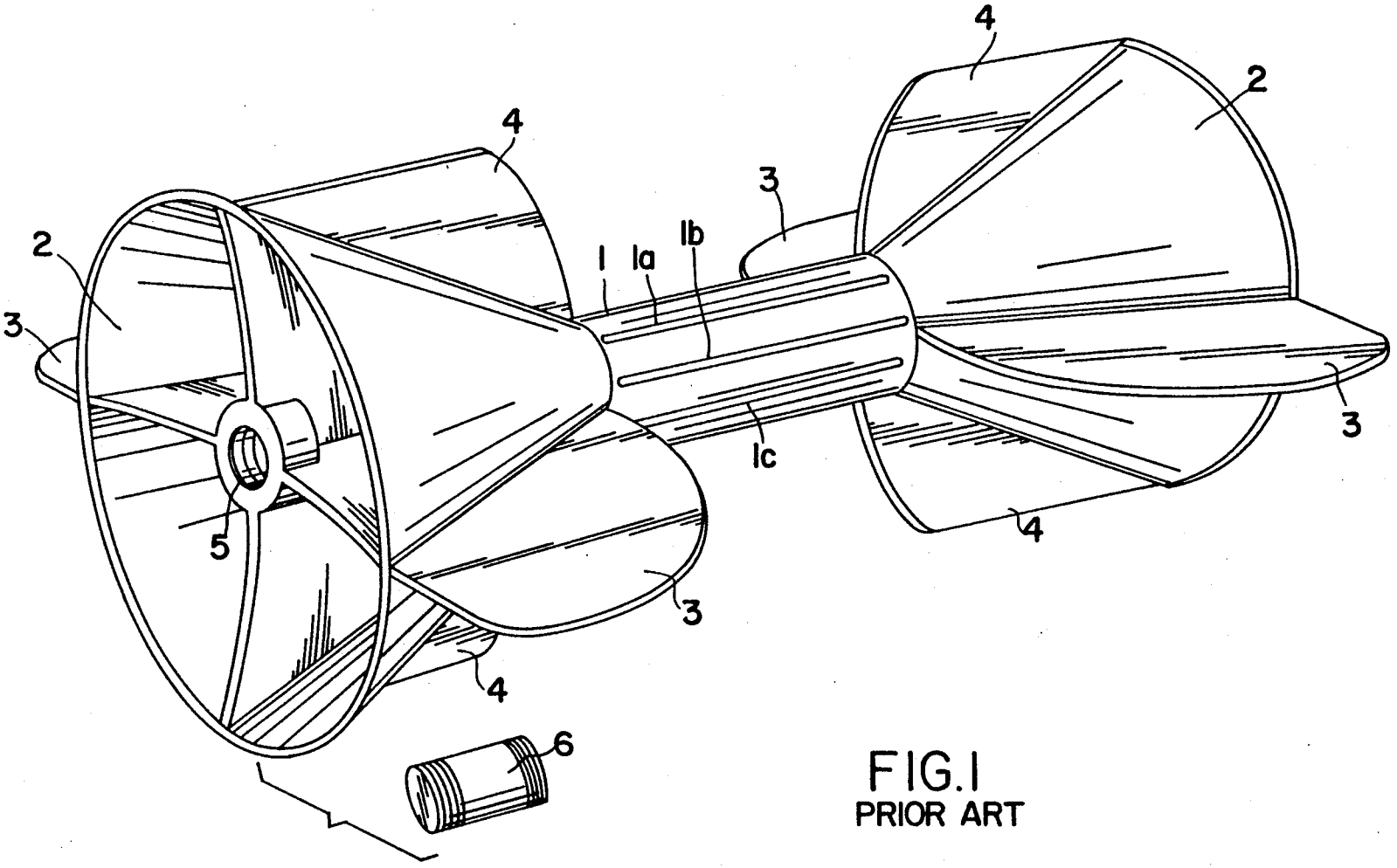
FIG. 1 PRIOR ART
FIG. 1 is a perspective view of the device of U.S. Pat. No. 4,623,142 which has been improved by means of the present invention.

FIG. 1 shows the basic exercise device disclosed in applicant's prior U.S. Pat. No. 4,623,142, comprising a hollow handle 1 operatively positioned between two opened funnels 2. The hollow handle 1 includes ridges 1*a*, 1*b*, 1*c* . . . which facilitate the gripping of the handle by an individual utilizing the aquatic exercising device. The opened funnel 2 includes vanes 3, 4 which are arranged substantially orthogonally with respect to each other. A coupler socket 5 is positioned at the intersection of the vanes 3, 4 and is centrally mounted with respect to the open end of the opened funnel 2. Each side of the hollow handle 1 includes an opened funnel 2 substantially as described hereinabove. A connector tube 6 may be provided to operatively connect one aquatic exercising device to another.

Figures 2, 4:
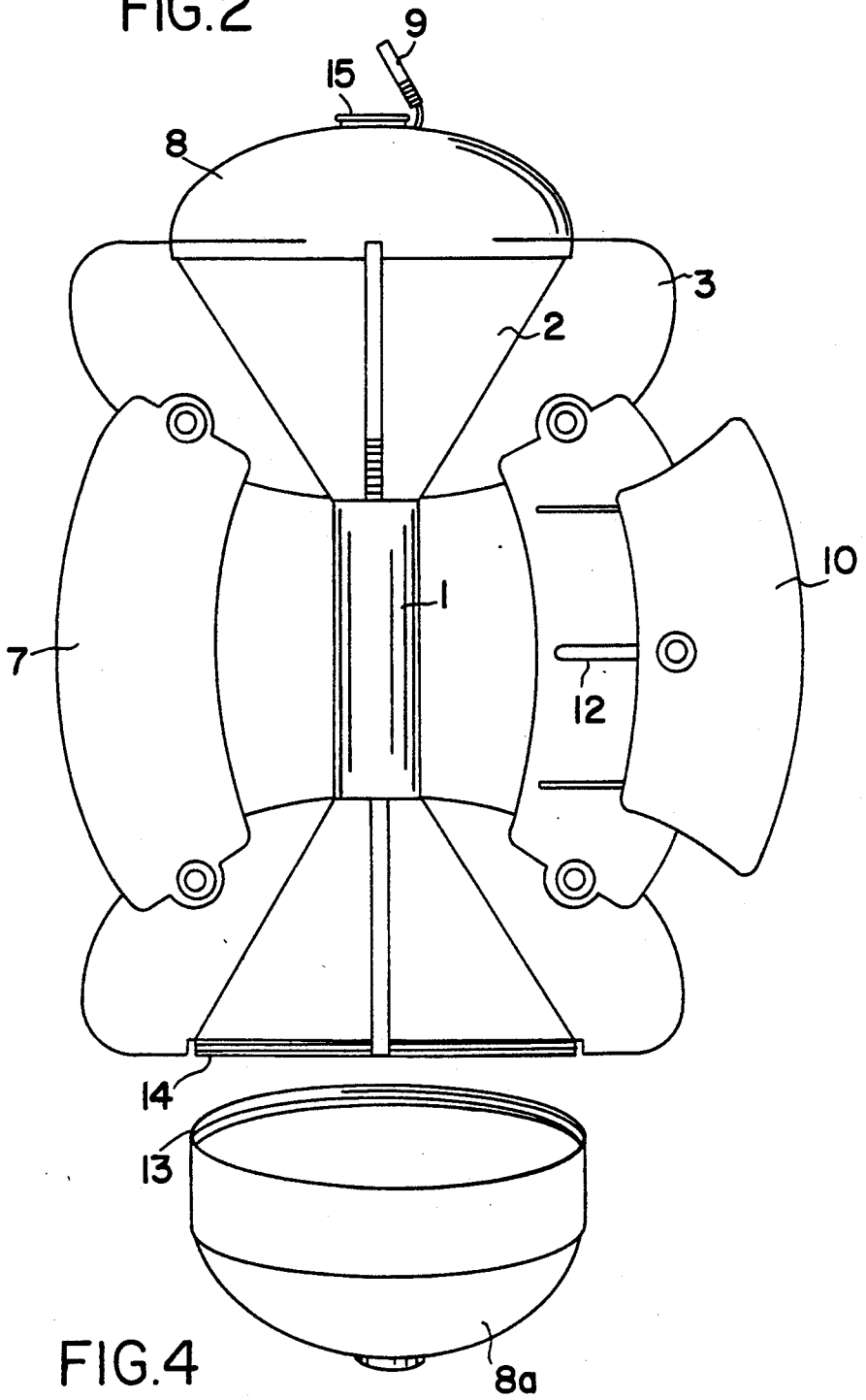
FIG. 2 is a plan view of the same device, with the improvements comprising connecting panel members and dome-shaped closure elements.
FIG. 4 is a perspective of a cup-shaped dome element of larger size, threaded so as to permit it to be screwed to a funnel-shaped support.

As shown in FIG. 2, the prior art device has been improved by the addition of two types of elements, namely, flat panel members 7 which connect the exterior portions of vanes 3, and dome-shaped elements 8 which close off the open ends of funnels 2, and which can be closed off by caps 9. It will be understood that either or both of these elements can be incorporated in the device.

Panel members 7 are preferably arranged substantially 180° apart in a common plane, and are spaced from handle member 1 by a distance sufficient to provide clearance for the hand of a user gripping the handle member. They have a width which is sufficient to substantially increase the resistance provided by the outwardly extending portions of vanes 3 and 4 when the device is pushed broadside through the water.

To further increase their effectiveness and to provide flexibility of use consistent with the ability of diverse users, flat panel members 7 (also referred to as power vanes) may be augmented by supplemental sliding panels 10 so that the width of these power vanes can be increased to approximately twice the original width. The supplemental sliding panels can be attached to flat panel members 7 in any suitable manner, e.g., by insertion of adjustment bolts 11 into transverse slots 12 provided in the sliding panels.

Figure 3:
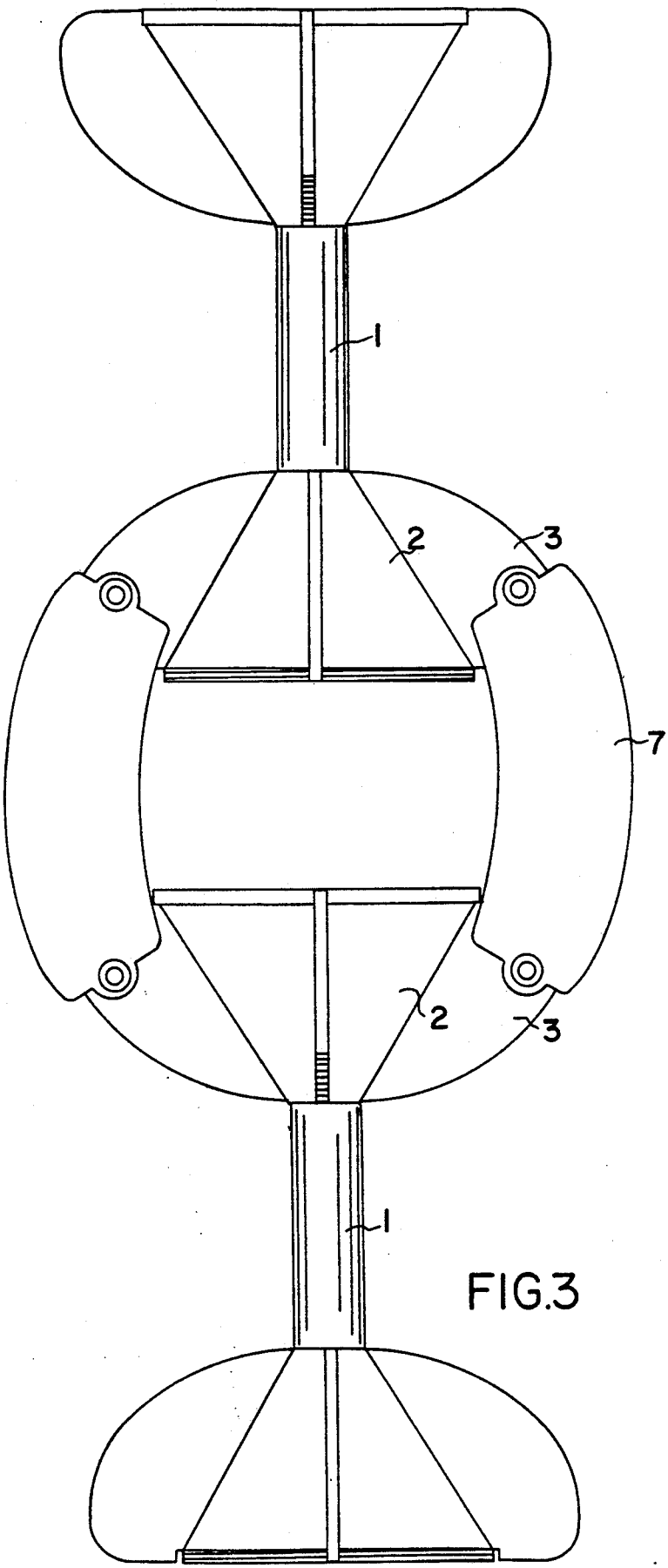
FIG. 3 is a plan view of two devices connected together by turning around the connecting panel members.

In a further modification, shown in FIG. 3, panel members 7 connect two exercise devices longitudinally aligned with one another, thereby enhancing the degree of resistance and the exercising capability of the user.

The dome-shaped elements 8 may have different sizes and/or configurations. They may, e.g., be hemispherical frusto-conical or cup-shaped. FIG. 4 shows a cup-shaped element 8*a* provided with female threading 13 at its inner edge, for screwing onto male exterior threading 14 provided on the outwardly facing ends of funnels 2, so as to create a watertight seal. Alternately, they may be snap-fastened. It will be understood that coupler socket 5 and connector tube 6, shown in FIG. 1, would be omitted in this construction. Fill holes 15 can be opened and closed by caps 9, which may be pivotably attached to elements 8, as shown in FIG. 2, or may be entirely removable plugs. The device may be filled with water through the fill holes so as to be usable as a gravity weight for exercising, the amount of water thus being variable to suit individual needs. When emptied of water, the device may be used for flotation or buoyancy resistance exercises.

What is claimed is:

1. An aquatic exercising device comprising:

(a) a hollow handle member having a first end and a second end;

(b) a first substantially funnel shaped support operatively connected to said first end of said handle;

(c) a second substantially funnel shaped support operatively connected to said second end of said handle;

(d) said first and second substantially funnel shaped supports being hollow and said hollow space being in communication with a hollow space in said handle member to permit water to flow therebetween;

(e) a first plurality of vanes operatively affixed to said first substantially funnel shaped support and extending within said hollow space of said first substantially funnel-shaped support; and (f) a second plurality of vanes operative affixed to said second substantially funnel shaped support and extending within said hollow space of said second substantially funnel shaped support;

(g) said plurality of first and second vanes including a vane forming a first resistance member which is smaller in size relative to the vane forming a second resistance member to provide substantially different resistance as each of the vanes is moved through a body of water, said second resistance member projecting outwardly from said funnel shaped supports beyond the diameter of the largest opening of said funnel shaped supports for improving the stability of the aquatic exercising device as it moves through a body of water;

(h) a plurality of substantially flat, curved panel members extending longitudinally of said device for distance extending beyond both ends of said hollow handle member, said panel members each having first and second ends respectively attached to portions of said first and second vanes extending outwardly from said first and second funnel shaped supports; and (i) means for detachably fastening said panel members to said outwardly extending portions of said first and second vanes;

(j) whereby movement of said device through a body of water produces a resistance to enhance the exercising capability of an individual utilizing the device.

2. A device according to claim 1, comprising two panel members arranged substantially 180° apart in a common plane.

3. A device according to claim 1, wherein inside edges of said panel members are spaced from said handle member by a distance sufficient to provide clearance for a hand of a user gripping said handle member.

4. A device according to claim 1, wherein said panel members have a width sufficient to substantially increase the amount of resistance provided by said outwardly extending portions of said first and second vanes when said device is pushed broadside through water.

5. A device according to claim 4, wherein said panel members have different widths so as to add variable amount of resistance to the device.

6. A device according to claim 1, wherein at least one of said panel members comprises a base panel and a supplemental panel whose position relative to said base panel is adjustable so as to vary the total surface area of said at least one panel member to approximately double the width of said at least one panel member.

7. An aquatic exercising device comprising:

(a) a hollow handle member having a first end and a second end;

(b) a first substantially funnel shaped support operatively connected to said first end of said handle;

(c) a second substantially funnel shaped support operatively connected to said second end of said handle;

(d) said first and second substantially funnel shaped supports being hollow and said hollow space being in communication with a hollow space in said handle member to permit water to flow therebetween;

(e) a first plurality of vanes operatively affixed to said first substantially funnel shaped support and extending within said hollow space of said first substantially funnel-shaped support; and (f) a second plurality of vanes operatively affixed to said second substantially funnel shaped support and extending within said hollow space of said second substantially funnel shaped support;

(g) said plurality of first and second vanes including a vane forming a first resistance member which is smaller in size relative to the vane forming a second resistance member to provide substantially different resistance as each of the vanes are moved through a body of water, said second resistance member projecting outwardly from said funnel shaped supports beyond the diameter of the largest opening of said funnel shaped supports for improving the stability of the aquatic exercising device as it moves through a body of water; and (h) at least one of said first and second funnel shaped supports having an open end closed by a substantially dome-shaped element having a centrally located aperture adapted to be closed by a cap.

8. A device according to claim 7, wherein said dome-shaped elements are hemispherical.

9. A device according to claim 7, wherein said dome-shaped elements are frusto-conical.

10. A device according to claim 7, wherein said dome-shaped elements are cup-shaped.

11. A device according to claim 7, wherein said dome-shaped elements are of different sizes so as to vary the volume of fluid inside said device.

12. A device according to claim 7, wherein said dome-shaped elements are attached to at least one said funnel shaped support by screwing so as to create a watertight seal.

13. A device according to claim 7, wherein said dome-shaped elements are attached to at least one said funnel shaped support by being snapped thereon so as to create a watertight seal.

14. A device according to claim 7, wherein said cap is provided with a resealable opening to enable said device to be filled with and easily drained of liquid, so as to permit said device to be selectively used as a flotation device and as a gravity weight.

15. A device according to claim 7, wherein said cap is a screw cap.

16. A device according to claim 7, wherein said cap is a plug.

17. An aquatic exercising device comprising:

(a) a hollow handle member having a first end and a second end;

(b) a first substantially funnel shaped support operatively connected to said first end of said handle;

(c) a second substantially funnel shaped support operatively connected to said second end of said handle;

(d) said first and second substantially funnel shaped supports being hollow and said hollow space being in communication with a hollow space in said handle member to permit water to flow therebetween;

(e) a first plurality of vanes operatively affixed to said first substantially funnel shaped support and extending within said hollow space of said first substantially funnel-shaped support; and (f) a second plurality of vanes operative affixed to said second substantially funnel shaped support and extending within said hollow space of said second substantially funnel shaped support;

(g) said plurality of first and second vanes including a vane forming a first resistance member which is smaller in size relative to the vane forming a second resistance member to provide substantially different resistance as each of the vanes are moved through a body of water, said second resistance member projecting outwardly from said funnel shaped supports beyond the diameter of the largest opening of said funnel shaped supports for improving the stability of the aquatic exercising device as it moves through a body of water; and (h) a plurality of substantially flat, curved panel members extending longitudinally of said device and each having first and second ends respectively attached to portions of said first and second vanes extending outwardly from said first and second funnel shaped supports;

(i) at least one said first and second funnel shaped supports having an open end closed by a substantially dome-shaped element having a centrally located aperture adapted to be closed by a cap;

(j) whereby movement of said device through a body of water produces a resistance to enhance the exercising capability of an individual utilizing the device.

18. An aquatic exercising device comprising:

(a) a hollow handle member having a first end and a second end;

(b) a first substantially funnel shaped support operatively connected to said first end of said handle;

(c) a second substantially funnel shaped support operatively connected to said second end of said handle;

(d) said first and second substantially funnel shaped supports being hollow and said hollow space being in communication with a hollow space in said handle member to permit water to flow therebetween;

(e) a first plurality of vanes operatively affixed to said first substantially funnel shaped support and extending within said hollow space of said first substantially funnel-shaped support; and (f) a second plurality of vanes operatively affixed to said second substantially funnel shaped support and extending within said hollow space of said second substantially funnel shaped support;

(g) said plurality of first and second vanes including a first resistance member which is smaller in size relative to the vane forming a second resistance member to provide substantially different resistance as each of the vanes is moved through a body of water, said second resistance member projecting outwardly from said funnel shaped supports beyond the diameter of the largest opening of said funnel shaped supports for improving the stability of the aquatic exercising device as it moves through a body of water; and (h) a plurality of substantially flat, curved panel members extending longitudinally of said device and each having first and second ends respectively attached to portions of said first and second vanes extending outwardly from said first and second funnel shaped supports;

(i) said device being coupled to a second, substantially identical device arranged in longitudinal alignment therewith by means of said panel members, said first and second ends of said panel members being attached to said first and second vanes extending outwardly from a said first funnel shaped support of said device and from a second funnel shaped support of said second device, respectively;

(j) whereby movement of said device through a body of water produces a resistance to enhance the exercising capability of an individual utilizing the device.

* * * * *

UNITED STATES PATENT AND TRADEMARK OFFICE

CERTIFICATE OF CORRECTION

PATENT NO. : 5,033,739

DATED : July 23, 1991

INVENTOR(S) : Bruce Mackechnie

It is certified that error appears in the above-indentified patent and that said Letters Patent is hereby corrected as shown below:

On title page, item [73] delete "Adams Mfg. Co., of Portersville, Pa."

Signed and Sealed this

First Day of March, 1994

Bruce Lehman

*Attest:*

BRUCE LEHMAN

*Attesting Officer*

*Commissioner of Patents and Trademarks*